US005379199A

United States Patent [19]

Hirshenhorn et al.

[11] Patent Number: 5,379,199

[45] Date of Patent: Jan. 3, 1995

[54] LOW PROFILE RECESSED WALL LIGHTING FIXTURE

[75] Inventors: Steven J. Hirshenhorn, Maple Glen; Steven T. Reisbord, Ardmore; William P. Galgon, Meadowbrook, all of Pa.

[73] Assignee: Progress Lighting, Philadelphia, Pa.

[21] Appl. No.: 895

[22] Filed: Jan. 6, 1993

[51] Int. Cl.[6] ..... F21S 1/02

[52] U.S. Cl. ..... 362/147; 362/151; 362/365; 362/449

[58] Field of Search ..... 362/146, 147, 151, 365, 362/368, 433, 296, 449

[56] References Cited

U.S. PATENT DOCUMENTS

| | | | |
|---|---|---|---|
| 1,844,639 | 2/1932 | Crumpton | 362/433 |
| 2,802,096 | 8/1957 | Isler | 362/365 |
| 2,922,029 | 1/1960 | Eschelbach et al. | 362/151 |
| 2,961,530 | 11/1960 | Stahlhut et al. | 362/364 |
| 4,336,575 | 6/1982 | Gilman | 362/147 |
| 4,514,792 | 4/1985 | Klaus | 362/147 |
| 4,733,339 | 3/1988 | Kelsall | 362/365 |
| 4,748,543 | 5/1988 | Swarens | 362/148 |
| 4,870,549 | 9/1989 | Lauckhardt et al. | 361/147 |
| 4,972,339 | 11/1990 | Gabrius | 362/365 |
| 5,034,869 | 7/1991 | Choi | 362/147 |
| 5,068,772 | 11/1991 | Shapiro et al. | 362/368 |
| 5,075,831 | 12/1991 | Stringer et al. | 362/365 |
| 5,142,459 | 8/1992 | Swarens et al. | 362/433 |
| 5,146,393 | 9/1992 | Crane | 362/365 |

FOREIGN PATENT DOCUMENTS

| | | | |
|---|---|---|---|
| 0551359 | 1/1958 | Canada | 362/365 |

*Primary Examiner*—Richard A. Bertsch
*Assistant Examiner*—M. Kocharov
*Attorney, Agent, or Firm*—Seidel, Gonda, Lavorgna & Monaco

[57] ABSTRACT

A recessed wall lighting fixture is disclosed comprising a recessed enclosure, a tray connected to and extending out from the recessed enclosure, and means for mounting the recessed enclosure in a predetermined orientation. The recessed enclosure has a back wall and an opened face with a flange portion. The tray extends out from the flange portion and provides a platform adapted for supporting a light diffuser. The tray also has an upright partition. The platform extends from the upright partition to the flange portion of the enclosure. The tray also includes an adjustable connecting means extendable between the upright partition to the flange portion for engaging the light diffuser. The tray can be attached to either of adjacent side walls of the enclosure, thereby allowing the light diffuser associated therewith to be oriented in either a horizontal or vertical position. The lighting fixture includes wall connecting structure allowing it to be either recessed behind a finished wall or attached to a wall under construction. The lighting fixture itself can also be mounted in the wall in either a horizontal or vertical orientation.

15 Claims, 7 Drawing Sheets

FIG. 1
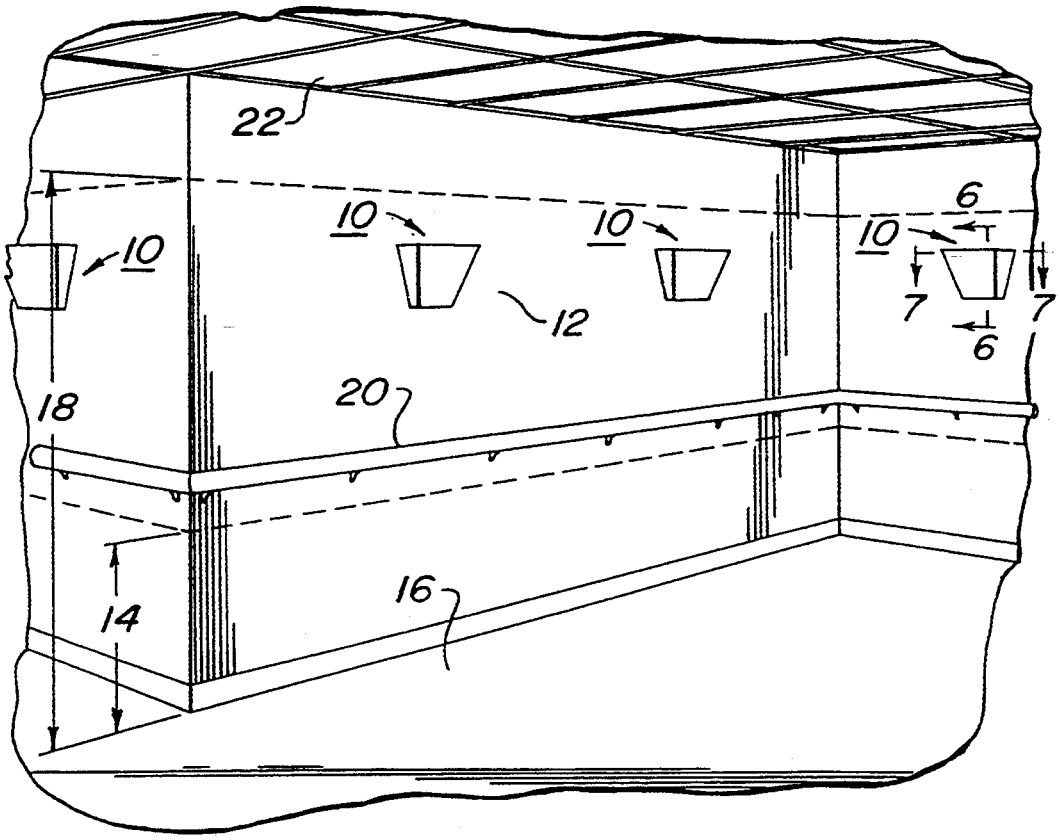
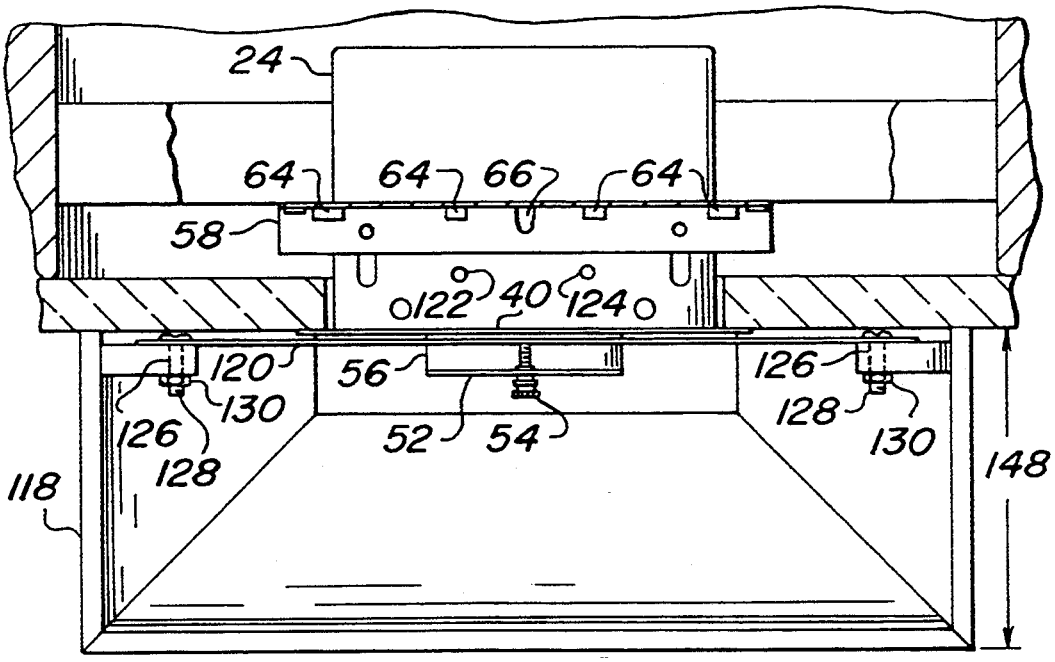
FIG. 7

FIG. 4
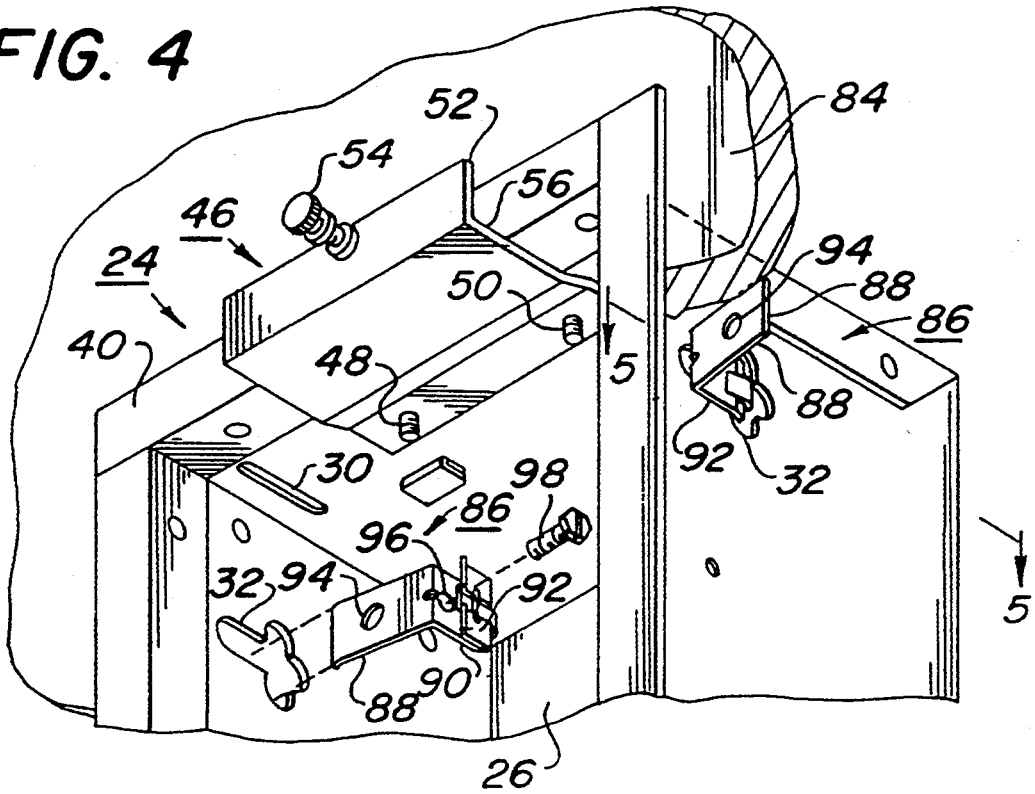
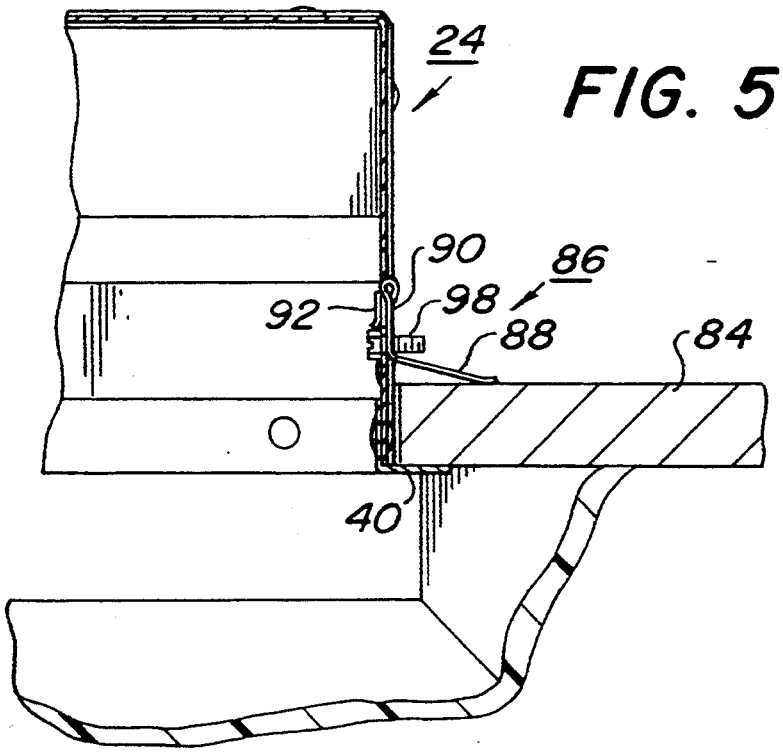
FIG. 5

LOW PROFILE RECESSED WALL LIGHTING FIXTURE

FIELD OF THE INVENTION

The present invention relates to lighting fixtures and, more particularly, to recessed wall lighting fixtures having light diffusers with limited outward extent from the sidewall housing the fixture.

BACKGROUND OF THE INVENTION

Wall lighting fixtures arc commonly used in commercial, residential, and public access buildings. Such wall lighting fixtures include the common term "sconces" that mount flush onto a wall and contain a light source (such as an incandescent or one or more fluorescent lamps). These wall sconces include an integral light diffuser that commonly projects outward from the wall and into an area, such as a room, corridor or other opening, by a distance greater than four (4) inches.

Lighting fixtures placed in public access buildings must now conform to the Americans with Disabilities Act of 1990 which has as one of its requirement a limitation on a distance from which devices, such as lighting fixtures, extend from sidewalls, corridors or passageways to be no greater than four (4) inches. This four (4) inch requirement is applicable from a height of about 27 inches (27") from the floor to a height of about 80 inches (80") from the floor. This requirement has created a strong driving force on the lighting industry to provide conforming wall sconces in such public access buildings as well as in hospitality, managed housing, restaurants, and retail store facilities. It is required that wall sconces be provided with means to limit their outward extent from walls to be no greater than four inches.

The light diffusers of the wall sconces provide the lighting fixture with different types of lighting patterns, such as indirect lighting, direct lighting, and combinations thereof. The use of different materials for the light diffusers achieve different lighting patterns and even different colored lighting patterns. For example, these diffusers may be either translucent or opaque to produce different light diffusion characteristics desired for different lighting applications. Further, the light diffusers may be selected to have different styles, such as shapes, textures and finishes to provide different lighting aesthetics. It is desired that means for the wall sconces be provided that allows the light diffusers to be conveniently changed so as to provide different lighting patterns and the different styles that meets the need of various lighting applications.

In addition to the light diffusers, the orientation of the light source of the wall sconce, which is determined by the orientation of the (recessed) lighting fixture itself, may also be arranged so as to provide for particular types of lighting such as up-lighting, down-lighting, or combinations thereof. These different types of lighting patterns are selected for particular requirements for the lighting application. The orientation of the recessed wall lighting fixture is dependent on the selection of a particular diffuser that may provide a certain light pattern or aesthetic style. The combination of various diffuser media and styles affords the user a wide selection of light patterns and style options.

Recessed wall lighting fixtures may be installed into new buildings under construction or into finished buildings. The installment of a recessed wall lighting fixture into a building under construction must accommodate the mounting onto wood or some other material, such as metal or masonry, frame members, such as support studs, exposed during new construction. Conversely, for finished buildings the recessed wall lighting fixture must accommodate the mounting onto a finished wall because stud framing members are no longer exposed. It is desired that means be provided to allow the recessed wall lighting fixtures to be installed into either buildings under construction or into finished walls of completed facilities.

Accordingly, it is an object of the present invention to provide a recessed wall lighting fixture having the capability of being installed into buildings that are either under construction or in their finished condition.

Another object of the present invention is to provide a recessed wall lighting fixture that may be oriented in either a horizontal or a vertical orientation so as to allow for up-lighting, down-lighting and combinations thereof.

A further object of the present invention is to provide a recessed wall lighting fixture having means that allow the associated light diffusers to be conveniently connected and reconnected so as to provide different lighting patterns, different diffuser styles and allow for the maintenance thereof in an easy and rapid manner without disturbing the electrical connections and components therein.

Moreover, it is an object to the present invention to provide recessed wall lighting fixtures that accommodate associated light diffusers which limits the outward extent of these light diffusers from the wall to be no more than four (4) inches so as to more than satisfy the requirement of the Americans with Disabilities Act of 1990.

Other objects, advantages and novel features of the present invention will become apparent in the following detailed description of the invention when considered in conjunction with the accompanying drawings.

SUMMARY OF THE INVENTION

The present invention is directed to recessed wall lighting fixtures having means that limit the outward extent from a wall of their associated light diffuser to be no more than four (4) inches.

The recessed wall lighting fixture comprises a recessed enclosure, a moveable tray connected to the recessed enclosure, and means for mounting the recessed enclosure in predetermined orientations. The recessed enclosure houses a light source, has a back wall and an opened face having a flange portion. The flange portion has length and width dimensions that exceed those of the back wall. The moveable tray provides for rapid disconnect and/or reconnect of associated light diffusers and has a partition member and connecting means having adjustment means that is extendable between the partition and the flange portion. The tray being moveable enables the associated light diffusers to be mated to the recessed enclosure when it is desired to orient any of the light diffusers in either a horizontal or vertical position. The recessed wall lighting fixture has an integral splice compartment that facilitates the electrical wiring thereof.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 illustrates typical locations of wall sconces in a public access building applicable to the requirements of the Americans with Disabilities Act.

FIG. 4 illustrates a further embodiment for mounting the recessed enclosure into a finished wall;

FIG. 5 is a view, taken along line 5—5 of FIG. 4, illustrating further details of the mounting of FIG. 4;

FIG. 7 is a view, taken along line 7—7 of FIG. 1, illustrating further details of connecting the light diffuser to the recessed enclosure;

DETAILED DESCRIPTION OF THE PREFERRED EMBODIMENTS

Figure 2:
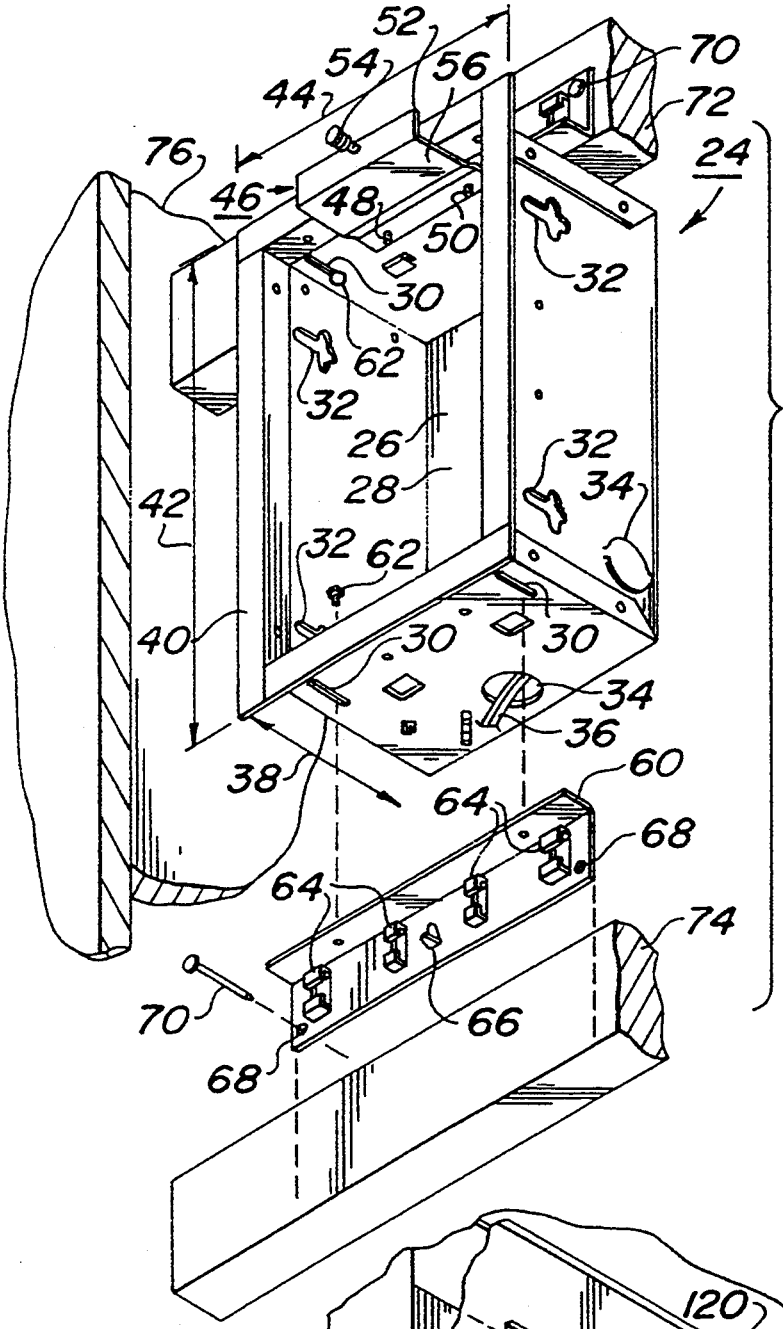
FIG. 2 is a perspective view of the recessed enclosure of the wall sconce of FIG. 1 having a first embodiment to accommodate the mounting of the enclosure in a building under construction.

With reference to FIG. 1, a lighting fixture 10 located in a wall 12 is illustrated. The lighting fixture 10 is commonly referred to as a "wall sconce" and is particularly suited to be used in a public access building applicable to the Americans with Disabilities Act of 1990. More particularly, the lighting fixture 10 more than satisfies one of the requirements of the Americans with Disabilities Act of 1990 by limiting the distance that any of its members extend outward from the wall 12 to be no more than about four (4) inches. This four (4) inch requirement is further defined as being within a height of about twenty-seven (27) inches (shown by reference line 14) from the floor 16 to a height of about eighty (80) inches (shown by reference line 18) from the floor 16. The lighting fixture 10 is shown in FIG. 1 within these boundaries and also as being located above a hand rail 20, but below a ceiling 22. The lighting fixture 10 is recessed within the wall 12 and has various embodiments that accommodates its mounting within building that arc in their construction stage or already finished. The flexibility of such mounting of the lighting fixture 10 that accommodates these various buildings may be described with reference to FIG. 2 illustrating a recessed enclosure 24.

The recessed enclosure 24 can be easily mounted in either a horizontal or a vertical orientation. Further, as is further described herein, the recessed enclosure 24, in cooperation with its light source, produces different lighting patterns for various lighting applications and at the same time provides the ability to easily accomplish maintenance and to also easily replace associated light diffusers so that these different lighting patterns may be conveniently achieved with the selection of the desired diffuser.

The recessed enclosure 24 has a back wall 26 preferably having a coating 28 placed thereon. Moreover, the coating 28 is placed on all of the interior surfaces of the enclosure 24 and is of a reflective substance, such as a white paint, so as to reflect the light rays generated by the light source (not shown in FIG. 2) outward from the interior of the recessed enclosure 24. The recessed enclosure 24 further has at least one aperture 30, which for the vertically-mounted orientation shown in FIG. 2, is placed in its upper and lower walls. The recessed enclosure 24 also has at least one aperture 32, preferably of a T-shaped arrangement, which for the vertical orientation of FIG. 2 is shown as being in its sidewalls. The apertures 30 or 32 are located in at least one of the side portions of the recessed enclosure 24 so as to accommodate for the connection of various stabilizing brackets and retaining clips to be described hereinafter. The recessed enclosure 24 further comprises a plurality of removeable apertures 34, sometimes referred to as "knockouts," selectively located in its sides so as to allow for the entrance and exit of the electric supply cable 36 (shown as entering into the bottom of the recessed enclosure 24 for the orientation of FIG. 2).

The enclosure 24 further has a typical depth 38 of about 3.5 inches maximum and a flange portion 40 on its face having predetermined dimensions 42 and 44, respectively, illustrating its length and width, and wherein the dimension of the length 42 exceeds that of the width 44. For the embodiment shown in FIG. 2, the maximum dimension, that is the length 42 is arranged in a vertical manner so as to correspondingly produce a vertical orientation of the recessed enclosure 24. The flanged front face 40 of the recessed enclosure 24 has dimensions that exceed those of the back wall 26 so that when the enclosure 24 is placed into an open wall, the flanged front face 40 defines the limit to which the recessed enclosure 24 enters the wall and provides a means of stabilizing the recessed enclosure 24 from falling back into the wall. The flange 40 when used in conjunction with retaining clips, to be further described with reference to FIGS. 4 and 5, secures the recessed enclosure 24 in a fixed position in the wall.

The recessed enclosure 24 has attached thereto a tray assembly 46 which is positioned into the recessed enclosure 24 so that the openings (not shown) of enclosure 24 are lined with openings (not shown) of tray 46, allowing the insertion and connection of fastening means 48 and 50, which are preferably of the screw type. The tray assembly 46 has an upright partition 52 and a connecting means, such as a thumb screw 54 serving as an adjustment means for engaging a light diffuser. As will be further discussed hereinafter with reference to FIG. 8, the tray 46 extends outward from the flange portion 40 so as to provide a platform 56 therebetween for supporting the light diffuser. The recessed enclosure 24 has different embodiments for its mounting into buildings still in construction or into their finished condition.

FIG. 2 illustrates a first embodiment for preferably mounting the recessed enclosure 24 into buildings under construction so that the recessed enclosure 24 is arranged in a vertical orientation by means of hangar brackets 58 and 60 that are respectively aligned to the pair of apertures 30 located at both the top and bottom of the recessed enclosure 24. The alignment allows for the connection by fastening members 62 placed within the aperture 30. For such a connection, each of the brackets 58 and 60 is arranged in a parallel manner relative to the front flange portion 40. Each of the brackets 58 and 60 has at least one preferably rectangular, squeezable clamping member 64 and preferably a hook-like squeezable clamping member 66. Still further, each of the brackets 58 and 60 further comprises at least one opening 68 for accepting a fastening means, such as a nail 70.

For the embodiments shown in FIG. 2, the recessed enclosure 24 is arranged with its maximum dimension 42 oriented in a vertical manner and with at least one, but preferably, two brackets 58 and 60 connected to the apertures 30 as to provide a vertical orientation of the enclosure 24. The recessed enclosure 24, in its mounted condition, is snugly positioned between wood frame member 72 and 74 both of which are exposed during construction and both of which are connected to an upright stud 76 comprising a framing member of the wall of the building under construction. The recessed enclosure 24 is mounted by hammering the nails 70 into both the wood members 72 and 74. Another embodiment for mounting the recessed enclosure in buildings under construction may be described with reference to FIG. 3.

Figure 3:
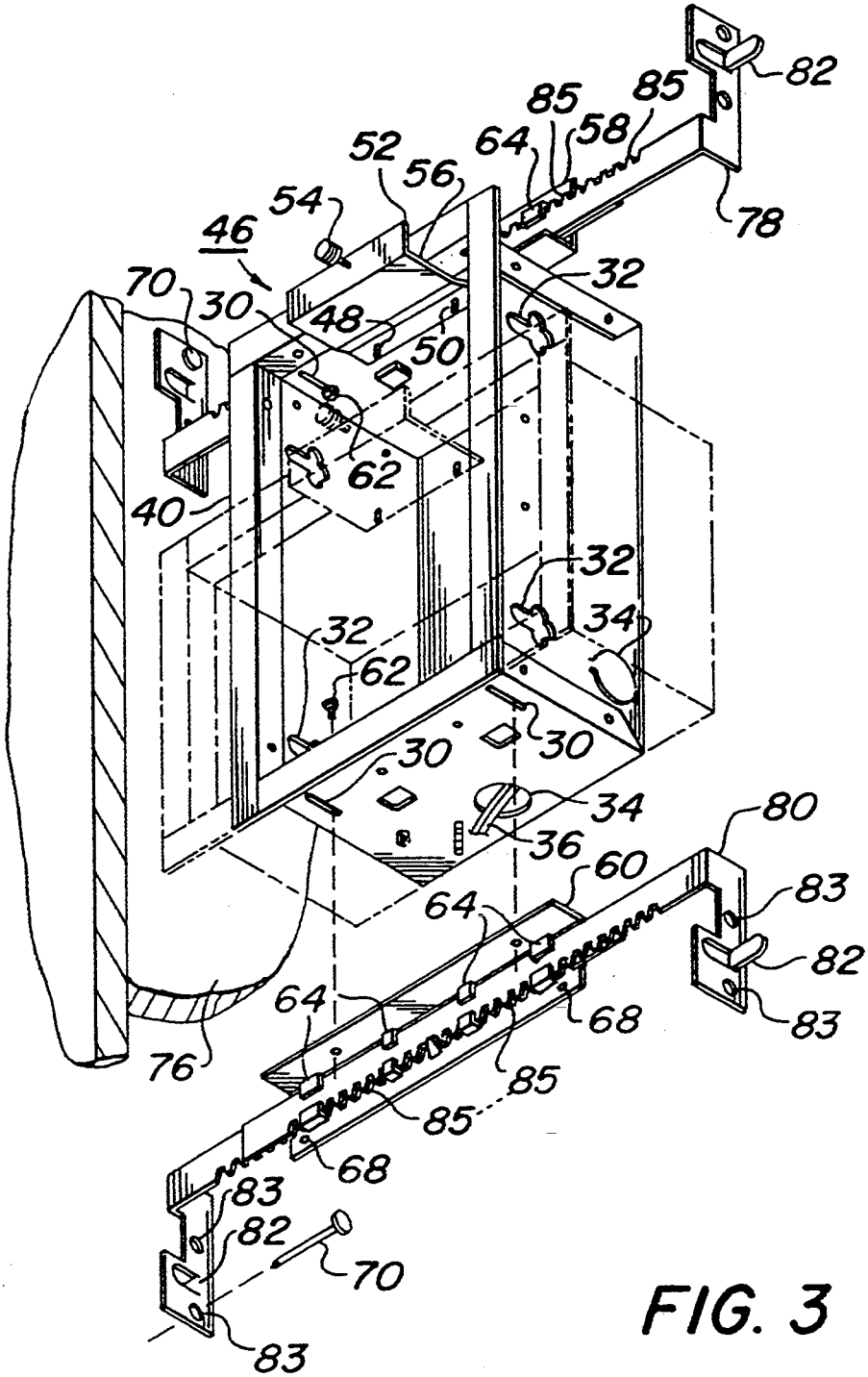
FIG. 3 illustrates another embodiment for mounting the recessed enclosure in a building under construction.

FIG. 3 is similar to FIG. 2 except that it illustrates the recessed enclosure 24 as having hanger brackets 58 and 60 respectively arranged relative to bar hangers 78 and 80. Each of the bar hangers 78 and 80 has barbs 82 at each of its ends that are driven into stud member 76. Additional support for the bar hangers 78 and 80 may be provided by inserting and hammering nails 70 into openings 83 so that the nails 70 are driven into the stud 76. The bar hangers 78 and 80 further have teeth 85, preferably having a saw tooth shape, and between which the clamp members 64 are engaged so as to confine or prevent any lateral movement of brackets 58 and 60 once the recessed enclosure 24 is mounted in position to the stud 76.

The recessed enclosure 24 is illustrated in FIG. 3 in two different orientations with the first being a vertical arrangement, shown with a solid representation, and the second being a horizontal orientation, shown in phantom. As seen in FIG. 3, the tray assembly 46 is moveable from the top (shown in solid) of the recessed enclosure for the vertical orientation to the side (shown in phantom) for the horizontal orientation. The tray being moveable enables the light diffusers (to be described) to be mated to the recessed enclosure when it is desired to orient any of the light diffusers in either a horizontal or vertical position. The mounting arrangements illustrated in FIG. 3 and also FIG. 2 are particularly suited for new construction facilities, whereas the mounting arrangement of the recessed enclosure for finished buildings may be described with reference to FIG. 4.

FIG. 4 illustrates the placement of the recessed enclosure 24 within a finished wall 84. To accomplish such a placement, the recessed enclosure 24, in particular, the back wall 26, may be used as a template for prescribing a line that defines the area to be removed from the wall 84, so as to allow for the removed section to serve as a pocket for mounting the recessed enclosure 24 in either a horizontal or vertical orientation. Alternatively, a cardboard device, having typical dimensions of a length of five and one-eighth inches ($5\frac{1}{8}$) inches and a width of seven and seven-eighths ($7\frac{7}{8}$) inches, may be used to define an area to be removed from the wall 84.

The recessed enclosure 24 is held in place within the wall 84 by means of a retaining clip 86 comprising a member having a first 88 and a second 90 portion perpendicularly arranged relative to each other, and a third portion 92 separated from the second portion 90 so as to provide a gap therebetween that has a dimension that slightly exceeds that of the thickness of the recessed enclosure 24. The first portion 88 has an aperture 94 therein and the second portion 90 also has an aperture 96 therein and into which a screw 98 is threadly engaged. FIG. 4 illustrates two retaining clips 86, with the first being aligned to a respective aperture 32, before insertion therein, and the second being already inserted into a respective aperture 32 and moveable along the outside of the recessed enclosure 24 and inward toward the wall within the aperture until the first portion 88 comes into engagement with the wall 84 as shown in FIG. 4. The engagement and affixation of trim bracket assemblies 86 to the wall 84 may be further described with reference to FIG. 5, which is a view taken along line 5—5 of FIG. 4.

As shown in FIG. 5, the retaining clips 86, typically four (4) in number, are placed on the outside of the recessed enclosure 24 and the portions 88, 90 and 92 are held within the T-shaped aperture 32 (see FIG. 4) by means of the screw 98. In operation, the retaining clip 86 is first slid forward until it firmly engaged the wall 84, and then the screw 98 is tightened which causes the first portion 88 to press against the wall 84 and, thereby, firmly affix, in conjunction with flange 40, the recessed enclosure 24 to the wall.

It should now be appreciated that the practice of the present invention provides means for mounting the recessed enclosure behind a finish wall and also onto flaming members of the wall of new construction facilities. The present invention provides such mounting so that the enclosure 12 may be oriented in either a vertical orientation (see FIG. 2) or a horizontal orientation (see FIG. 3 in phantom). The horizontal and vertical orientations of the recessed enclosure 24 in cooperation with the light generated by the related light source provides for direct or indirect lighting patterns. A related light source may be further described with reference to FIG. 6.

Figure 6:
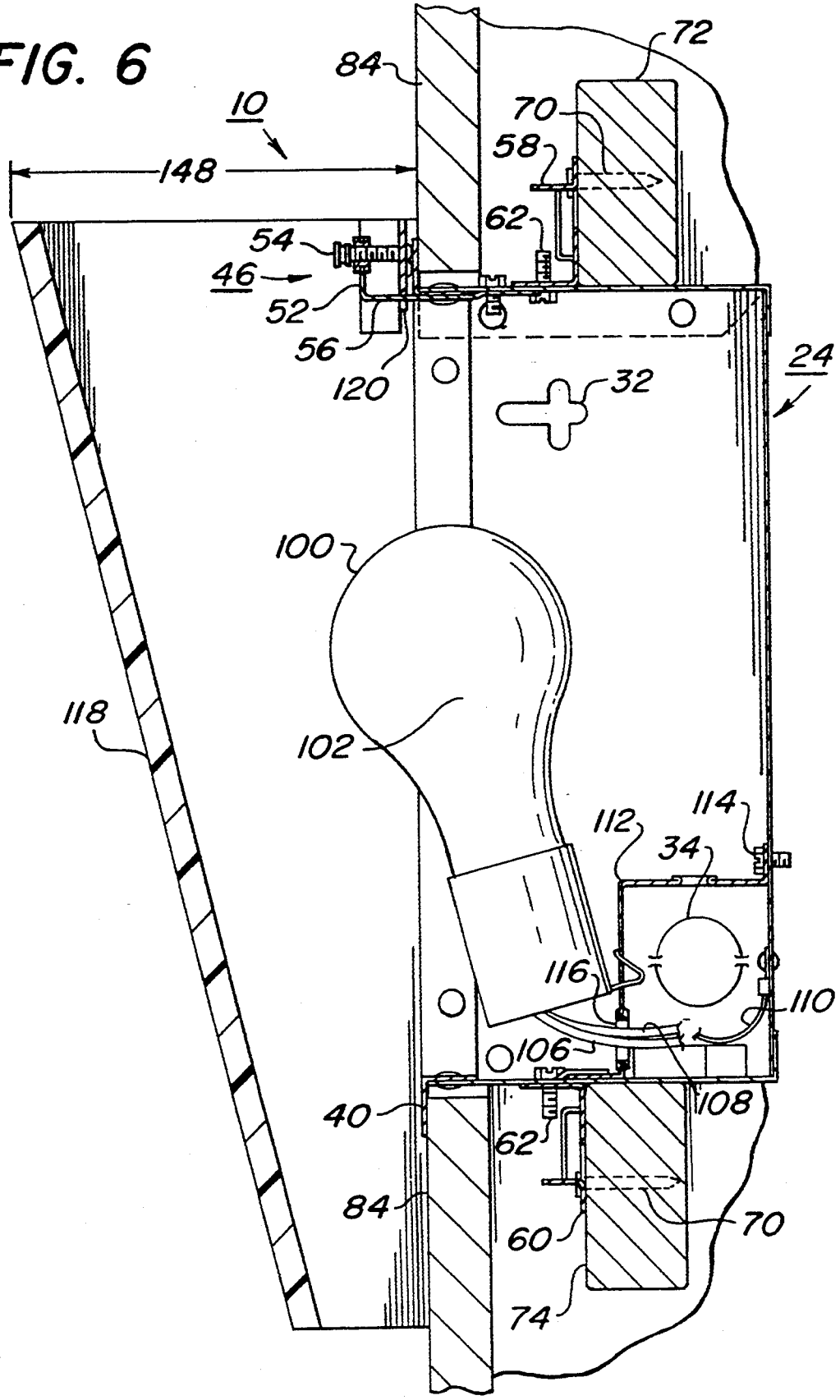
FIG. 6 is a view, taken along line 6—6 of FIG. 1, illustrating the housing of an incandescent light source in the lighting fixture of FIG. 1 and also illustrating the connection of a light diffuser to the same fixture.

FIG. 6 illustrates an incandescent light source 100 extending out of the recessed enclosure 24 but having its optical center 102 still within the confines of the recessed enclosure 24. FIG. 6 further illustrates the recessed enclosure 24 connected to wood frame member 72 and 74 in a manner as described with reference to FIG. 2. The light source 100 is mated with a socket 104 which has connected thereto power wires 106, 108 and 110 (all partially shown) of electrical cable 36 that, in one embodiment, is brought into a splice compartment 112 through the removed knockout 34 (see FIG. 2 for a clearer showing of element 34). The splice compartment 112 of FIG. 6 is affixed to the recessed enclosure 24 by means of connector 114 and lances 115 (only one shown). The splice compartment 112 is preferably a portion of the recessed enclosure 24 so that the electrical cable 36 need only be connected to one enclosure, that being the recessed enclosure 24, thereby, facilitating the effort needed to accomplish the electrical connections and precluding the need of a separate electrical enclosure as in a separate junction or outlet box. The internal splice compartment not only eliminates the cost of a separate junction box but also enables the installer to the recessed enclosure 24 to make all of his electrical connections within one device. The internal splice compartment in the recessed enclosure 24 also provides a means to allow for continuous wiring from the splice compartment of one recessed enclosure 24 to the splice compartment of another recessed enclosure 24.

The recessed enclosure 24 is further preferably provided with a thermal protector 116 interconnected (not shown) to the electrical wires 106 and 108 and is rendered operative in a manner known in the lighting field, so as to disconnect the power to the incandescent lamp 100, when the thermal protector 116 senses a temperature that exceeds a predetermined limit more than likely signifying that an over-temperature condition may be present and that the power should be removed from the lamp 100 so as to prevent any related heat damage.

FIG. 6 is a view, taken along line 6—6 of FIG. 1, illustrating the interconnection of the recessed enclosure 24 to a light diffuser 118 both of which comprise the lighting fixture 10 commonly referred to as the wall sconce. For the vertical orientation of the recessed enclosure 24 and light diffuser 118 as shown in both FIGS. 1 and 6, the light diffuser 118 is releasable connected to tray 46 (mounted on the top of the recessed enclosure 24) by means of the connecting means 54 of tray 46 being adjusted so that its shaft frictionally engages a trim member 120. The trim member 120 is connected to the light diffuser 118 and may be further described with reference to FIG. 7, which is a view taken along line 7—7 of FIG. 1.

FIG. 7 shows the tray 46 connected to the recessed enclosure 24 by means of attachment means 122 and 124. FIG. 7 further shows the light diffuser 118 as having at least one aperture 126 (shown in phantom) into which is inserted a bolt 128 that is then fastened to nut 130 so that the trim member 120 is rigidly affixed to the light diffuser 118. The trim member 120 rests upon platform 56 of the tray 46 and may be again further described with reference to FIG. 8.

Figure 8:
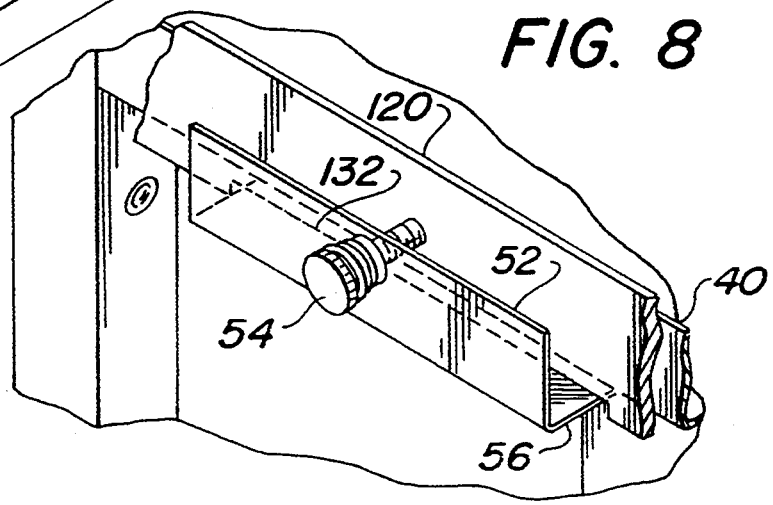
FIG. 8 illustrates the essential features of mounting a trim to the tray for rapidly connecting and/or disconnecting the light diffuser to the recessed housing of the present invention.

FIG. 8 illustrates the trim member 120 having a stepped portion 132 (shown in phantom) formed by the removal of a section from trim member 120. The trim member 120 is releasably connected to the front flange 40 of the recessed enclosure 24 by simply guiding the trim member 120 so that stepped portion 132 straddles and rests on the platform, and then merely adjusting thumb-screw 54 so that its shaft frictionally engages trim member 120 pushing it back so as to flushly mount the trim member 120 against the front flange 40. This simple procedure is reversed when it is desired to remove or exchange the light diffuser 118.

It should now be appreciated that the present invention provides means to allow the light diffusers to be easily connected and/or disconnected from the recessed housing 24. The ability to rapidly change the light diffuser allows for the convenience of replacing light diffusers in a rapid manner so as to easily achieve various light patterns, general maintenance thereof, and various aesthetic styles that are particularly suited for different lighting applications. Further, such ability is provided without disturbing the electrical connections and components of the recessed wall lighting fixture. The releasable connection of another light diffuser 134 to the recessed enclosure 24 may be described with reference to FIG. 9.

Figure 9:
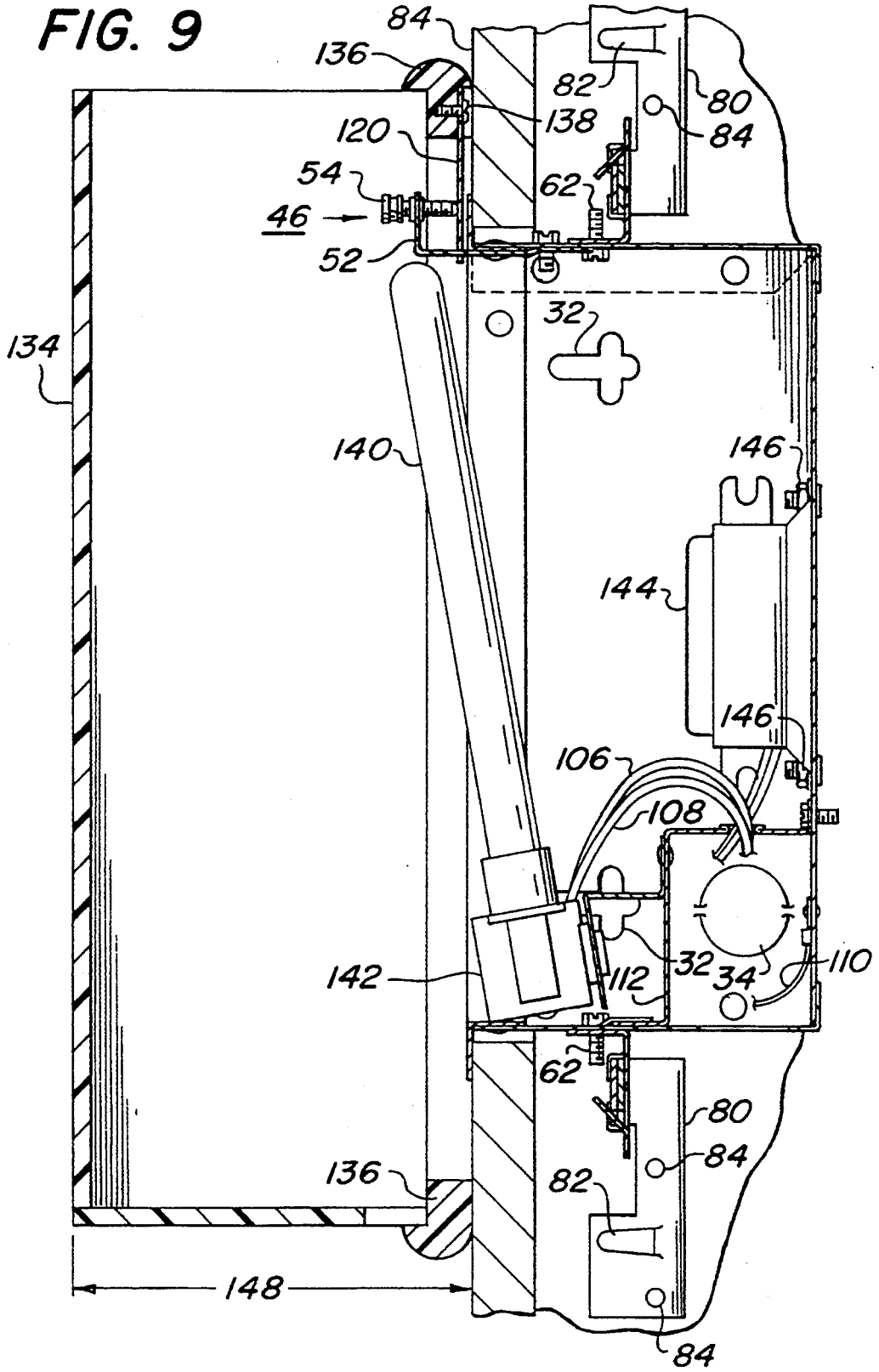
FIG. 9 illustrates the placement of a fluorescent light source in the lighting fixture of the present invention and the connection of another light diffuser to the same recessed enclosure.

FIG. 9 illustrates the other light diffuser 134 as having at least one aperture therein into which is threadly engaged a screw 138 so that the trim member 120 is rigidly affixed to the light diffuser 134 in a manner similar to that described with reference to FIG. 7. The light diffuser 134 is mounted onto and held in place by the tray assembly 46 of a vertically oriented recessed enclosure 24 that houses two (only one shown in FIG. 9) fluorescent lamps 140.

The fluorescent lamps 140 may be of a miniature type, such as PL-13 lodged in a corresponding lamp holder 142 and operated by a ballast 144 that is connected to the recessed enclosure 24 by means of screw-type connectors 146. The fluorescent light sources 140 of FIG. 9, as well as the incandescent light source 100 of FIG. 6, both cooperate with a selectable light diffusers, such as the light diffuser 118 of FIG. 6 or the light diffuser 134 of FIG. 9, that are easily mounted to the recessed enclosure 24.

The mounting of the incandescent lamp (FIG. 6) and fluorescent light sources (FIG. 9) are advantageously provided so that desired light patterns are generated and focussed by the lighting fixture 10 of the present invention. More particularly, all the electrical connections and all the associated components of the light sources are located behind the light sources in a predetermined manner. Such predetermined locations allow the light generated by the light sources to pass forward unimpeded by any hardware that would otherwise cast unwanted shadows onto the light diffuser 118 or 134.

Furthermore, the mounting of the incandescent and fluorescent light sources allows the light source to be separated from the light diffusers 118 and 136 by a sufficient amount so as to eliminate any imaging distortions sometimes called "hot spots" commonly seen by an observer viewing a recessed lighting fixture not having the benefits of the present invention.

Moreover, and with reference to the discussion given in the "Background" section, the mounting of the lighting fixture 10 of the present invention shown in FIGS. 6, 7 and 9 more than satisfies the requirement of the Americans with Disabilities Act. As shown in these FIGS. 6, 7 and 9, the recessed wall lighting fixture 10 flush mounts all of its light diffusers (such as 118 and 136) so that the distance 148 which any one of these light diffusers extend outward from the wall 84 is no more than about four (4) inches. This four (4) inch limitation is achieved, in part, by snugly fitting the light diffusers against the tray 46 and by providing apertures 30 and 32 so that the recessed housing 24 may be rigidly affixed behind the wall 84 by a sufficient amount to provide this four (4) inch limitation. Further, the predetermined recessed locations of the components associated with the light sources assist in achieving this four (4) inch limitation.

It should now be appreciated that the practice of the present invention allows for the light diffusers to be easily connected or disconnected from the recessed enclosure so that a variety of different light patterns and a variety of different styles having their aesthetic effects may be achieved and such lighting patterns may be described with reference to FIGS. 10 and 11.

Figure 10:
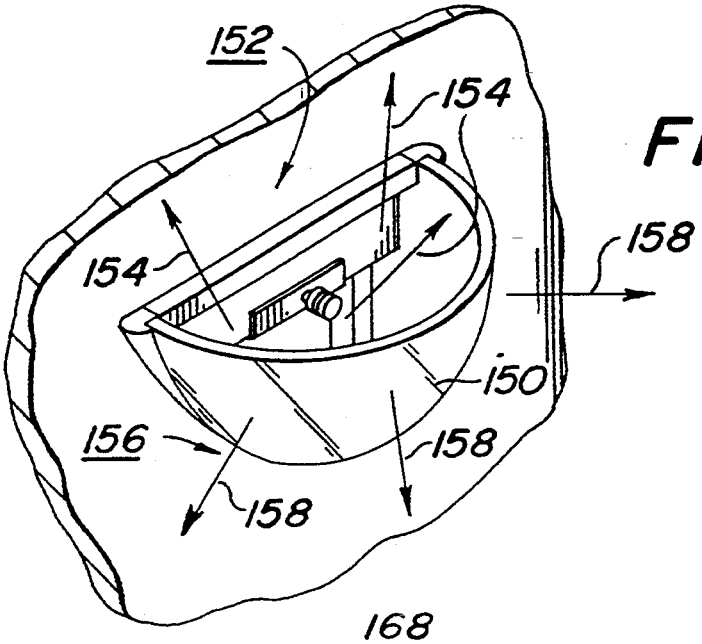
FIG. 10 illustrates a light diffuser mounted to a finished wall and directing the light rays generated by its light source in both an upward and outward manner.
Figure 11:
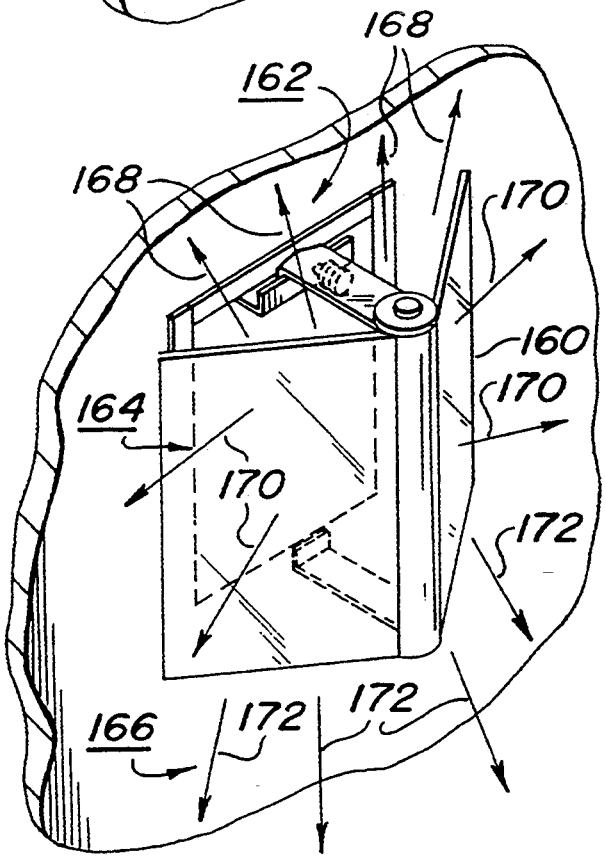
FIG. 11 illustrates a light diffuser mounted to a finished wall and directing the light rays generated by its light source in an upward, downward and outward manner so as to provide up-lighting, down-lighting and light that is directed outward through the diffuser.

FIG. 10 illustrates a light diffuser 150 that produces an upwardly directed light pattern 152 comprising a plurality of light rays 154 and an outwardly directed light pattern 156 comprising a plurality of light rays 158. For such upward and outward light patterns 152 and 156, respectively, the light diffuser 150 has a circular shape and the recessed enclosure 24 (not shown) is horizontally mounted.

A further lighting fixture that produces indirect, direct and outward lighting patterns may be described by reference to FIG. 11. FIG. 11 illustrates a light diffuser 160 that cooperates with a vertically oriented recessed enclosure 24 (not shown) so as to produce upward lighting 162, outward lighting 164 and downward lighting 166 that respectively comprise a plurality of light rays 168, 170 and 172.

The light diffusers that are used with the recessed enclosure 24 may be selected to have any particular type of shape and be of a medium, such as acrylic, metal or glass, so that a multiplicity of direct (down-lighting), indirect (up-lighting) or outward lighting patterns may be produced or any combination thereof.

It should now be appreciated that the present invention provides for a lighting Fixture that may be horizontally or vertically oriented and arranged with a diffuser having various shapes and sizes so that substantially any desired lighting pattern may be achieved. Further, the recessed enclosure 24 of the present invention may be arranged with its hanger bars or related retaining clips so that the enclosure may be mounted (hanger bars) onto wall studs commonly found in new construction or into finished walls (retaining clips). Moreover, the practice of the present invention provides a recessed lighting fixture that more than satisfies the requirement of the Americans with Disabilities Act and also fulfills an unsatisfied need of the lighting industry.

The present invention may be embodied in no specific forms without departing from this invention or essential attributes thereof and, accordingly, reference should be made to the appended claims rather than the foregoing specification indicating the scope of the invention.

What we claim is:

1. A lighting fixture assembly comprising:

(a) a recessed enclosure that houses a light source, said recessed enclosure having a back wall and an opened face with a flange portion, said flange portion having predetermined length and width dimensions that exceed those of the back wall;

(b) a tray connected to said recessed enclosure and extending outward from said flange portion and providing a platform adapted for supporting a light diffuser, said tray having an upright partition, said platform extending between from about the upright partition of the tray to about the flange portion, the tray further including adjustable connecting means extendable between from about the upright partition of the tray to about said flange portion for engaging the light diffuser; and (c) means for mounting said recessed enclosure in a predetermined orientation.

2. A lighting fixture assembly according to claim 1, wherein said recessed enclosure has at least one aperture located behind said flange portion, and said means for mounting comprises a retaining clip having two perpendicularly arranged portions, said retaining clip positionable into and moveable within said at, least one aperture so that one of its portions slides along the outside of said enclosure and is adapted for contacting a finished wall, the lighting fixture thereby adapted to be recessed behind a finished wall.

3. A lighting fixture assembly according to claim 1, wherein said recessed enclosure further includes at least one side portion having at least one aperture therethrough, and said means for mounting comprises at least one bracket member that is fastened to said at least one aperture in said side portion, said bracket member having at least one aperture serving as an opening for accepting at least one fastening means.

4. A lighting fixture assembly according to claim 1, wherein said recessed enclosure further includes at least one side portion having at least one aperture therethrough and said means for mounting comprises (i) at least one bracket member that is fastened to said at least one aperture in said side portion, said at least one bracket member having at least one clamping member, and (ii) at least one hanger member that is engagable by said at least one clamping member.

5. A lighting fixture according to claim 1 wherein said recessed enclosure has a depth of no greater than about three and one-half inches.

6. A lighting fixture according to claim 1, wherein said recessed enclosure further comprises a splice compartment having at least one removable portion so as to allow the entrance and exit of the leads of an electrical supply cable into said recessed enclosure and also to allow for continuous wiring from the splice compartment of one of said lighting fixture to the splice compartment of another of said lighting fixture.

7. A lighting fixture according to claim 1, wherein said back wall comprises a template for marking a section of a finished wall so that said marked section may be removed and provide a pocket for mounting said recessed enclosure.

8. A lighting fixture according to claim 1, wherein the electrical connections and all associated electrical components of said light source are physically located behind said light source so that the light rays directed outward from the recessed enclosure are not impeded by said connections and said components and to allow maintenance to be performed without disturbing said connections and said components.

9. A lighting fixture according to claim 1, wherein said recessed enclosure has a reflective coating covering its interior surface.

10. A lighting fixture according to claim 1, wherein said enclosure includes fastening structure along two adjacent side walls, thereby allowing said tray to be attached to either side wall, and thereby also allowing said light diffuser associated therewith to be oriented in either a horizontal or vertical position.

11. A lighting fixture according to claim 1, further comprising:

(d) a light diffuser supported by the moveable tray and engaged by the adjustable connecting means.

12. A lighting fixture assembly according to claim 11, wherein the light diffuser comprises (i) a body portion including a section with at least one cutout for engaging at least one fastener; and (ii) a strap member attached to the body portion having a stepped portion with a dimension so that the stepped portion spans at least across the platform of said tray, said strap member being attached to said body portion by said at least one fastener engaging said cutout, said strap member being placed so that its stepped portion straddles said tray and so that the strap member is engaged by said adjustable connecting means of said tray.

13. A lighting fixture according to claim 11, wherein said light diffuser extends outward from said flange portion by a distance which is no greater than about four inches.

14. A lighting fixture according to claim 11, wherein said light source is separated from said light diffuser by a sufficient amount so as to eliminate any visual hot spots of said light source.

15. A lighting fixture according to claim 11, wherein said light diffuser comprises material selected from the group comprising metallic, acrylic and glass materials.

* * * * *